US008207671B2

(12) United States Patent
Hwang et al.

(10) Patent No.: US 8,207,671 B2
(45) Date of Patent: Jun. 26, 2012

(54) PLASMA DISPLAY PANEL WITH TWO DISCHARGE ELECTRODES

(75) Inventors: Yong-Shik Hwang, Suwon-si (KR); Kyoung-Doo Kang, Suwon-si (KR); Won-Ju Yi, Suwon-si (KR); Jae-Ik Kwon, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 402 days.

(21) Appl. No.: 12/134,110

(22) Filed: Jun. 5, 2008

(65) Prior Publication Data

US 2008/0303441 A1 Dec. 11, 2008

(30) Foreign Application Priority Data

Jun. 7, 2007 (KR) ..... 10-2007-0055722

(51) Int. Cl.
*H01J 17/49* (2012.01)

(52) U.S. Cl. ..... 313/584; 313/582

(58) Field of Classification Search ..... 313/584, 313/583, 582; 445/24, 25
See application file for complete search history.

(56) References Cited

U.S. PATENT DOCUMENTS

2005/0225241 A1* 10/2005 Woo et al. ..... 313/582
2006/0132038 A1* 6/2006 Kweon ..... 313/582
2006/0132040 A1* 6/2006 Kweon ..... 313/583
2006/0186778 A1* 8/2006 Yoo et al. ..... 313/3
2006/0232209 A1* 10/2006 Kang et al. ..... 313/582
2006/0267868 A1* 11/2006 Kim et al. ..... 345/60
2007/0046202 A1* 3/2007 Kang et al. ..... 313/582
2007/0063651 A1* 3/2007 Yoo et al. ..... 313/583
2008/0111486 A1* 5/2008 Chun et al. ..... 313/586

FOREIGN PATENT DOCUMENTS

KR 10-2007-0056628 6/2007

OTHER PUBLICATIONS

Korean Office Action, dated Feb. 11, 2008, corresponding to Korean Priority Application No. 10-2007-0055722, along with English translation.
Korean Patent Abstract, Publication 1020070056628 A, Published Jun. 4, 2007, for Kim, et al.

* cited by examiner

*Primary Examiner* — Mariceli Santiago
*Assistant Examiner* — Glenn Zimmerman
(74) *Attorney, Agent, or Firm* — Christie, Parker & Hale, LLP

(57) ABSTRACT

A plasma display panel including: a first substrate and a second substrate utilized to display images; a dielectric wall disposed between the first and second substrates and defining a plurality of discharge cells; a first discharge electrode disposed in the dielectric wall; a second discharge electrode disposed on the second substrate to cross the first discharge electrode; and a phosphor layer formed on the first substrate. Accordingly, plasma can efficiently arrive at the phosphor layer, thereby increasing discharge efficiency.

18 Claims, 5 Drawing Sheets

PLASMA DISPLAY PANEL WITH TWO DISCHARGE ELECTRODES

CROSS-REFERENCE TO RELATED PATENT APPLICATION

This application claims priority to and the benefit of Korean Patent Application No. 10-2007-0055722, filed on Jun. 7, 2007 in the Korean Intellectual Property Office, the entire content of which is incorporated herein by reference.

BACKGROUND OF THE INVENTION

1. Field of the Invention

The present invention relates to a plasma display panel, and more particularly, to a plasma display panel having a discharge space with a phosphor layer.

2. Description of the Related Art

Plasma display panels are flat display devices in which discharge gas is injected between two or more substrates on which a plurality of discharge electrodes are disposed and vacuum ultraviolet rays generated by discharge of the discharge electrodes excite a phosphor material of a phosphor layer to display desired numbers, letters or images.

The plasma display panels can be classified as alternating current (AC) plasma display panels or direct current (DC) plasma display panels according to the operating principle of the driving voltage applied to discharge cells (e.g., according to their discharge modes). Also, plasma display panels can be classified as surface discharge type or facing discharge type plasma display panels according to the orientation of the discharge electrodes.

FIG. 1 illustrates a conventional three-electrode surface discharge type plasma display panel 100 including a first substrate 101, a second substrate 102 facing the first substrate 101, a sustaining discharge electrode pair 103 including an X electrode 104 and a Y electrode 105 which are formed on an inner surface of the first substrate 101 (or a surface of the first substrate 101 facing the second substrate 102), a first dielectric layer 106 which covers the sustaining discharge electrode pair 103, a protection layer 107 coated on the first dielectric layer 106, an address electrode 108 formed on the second substrate 102 and disposed to cross the sustaining discharge electrode pair 103, a second dielectric layer 109 covering the address electrode 108, barrier ribs 110 installed between the first and second substrate 101 and 102, and red, green, and blue phosphor layers 111 formed in discharge cells. In the space between the combined first and second substrates 101 and 102, discharge gas is injected to form a discharge region.

In the conventional plasma display panel 100, an electric signal is applied to the Y electrode 105 and the address electrode 108 to select discharge cells and then electric signals are alternately applied to the X and Y electrodes 104 and 105 so that surface discharge is generated from a surface of the first substrate 101 and thus ultraviolet rays are generated, and in turn excite the phosphor layers 111 of the selected discharge cells to emit visible light to realize a still image or a moving image.

However, the conventional plasma display panel 100 has the following problems.

First, since not only the sustaining discharge electrode pairs 103, but also the first dielectric layer 106 and the protection layer 107, are formed on the inner surface of the first substrate 101, a transmission ratio of visible light generated in the discharge cells is less than 60%. Thus, the conventional plasma display panel 100 cannot be a highly efficient flat panel device.

Second, when the conventional plasma display panel 100 is operated for a long period of time, discharge is diffused toward the phosphor layer 111, and charge particles of the discharge gas generate ion sputtering in the phosphor layer 111 and this can cause permanent latent images.

Third, since discharge is diffused from discharge gaps between the X electrodes 104 and the Y electrodes 105, namely, along the plane of the first substrate 101, a space usability ratio of all discharge cells is relatively low.

Fourth, when a high density discharge gas containing Xe gas having 10% by volume or higher is injected into the discharge cells, the number of charge particles and excited states are increased by ionization and excitation of elements, thereby increasing brightness and discharge efficiency; however, the initial discharge firing voltage is also disadvantageously increased because of the high density Xe gas.

SUMMARY OF THE INVENTION

Aspects of embodiments of the present invention are directed toward a plasma display panel in which the structure (s) of discharge electrodes, dielectric layers covering (or burying) the discharge electrodes, and/or phosphor layers is (or are) improved to increase discharge efficiency.

An embodiment of the present invention provides a plasma display panel. The plasma display panel includes: a first substrate and a second substrate utilized for displaying images; a dielectric wall between the first and second substrates and defining a plurality of discharge cells; a first discharge electrode within the dielectric wall and extending along a first direction; a second discharge electrode on the second substrate and extending along a second direction crossing the first direction of the first discharge electrode; and a phosphor layer on the first substrate.

In one embodiment, the first substrate has a plurality of grooves to correspond to the discharge cells and provide a space in which the phosphor layer is coated, and each of the grooves has a horizontal cross-section larger in area than that of each of the discharge cells. Here, a portion of a surface of the dielectric wall for contacting the first substrate may be exposed to the discharge cells due to the larger cross-sections of the grooves.

In one embodiment, a distance between an edge of the first discharge electrode and a surface of the dielectric wall contacting the discharge cells is greater than a distance between a surface of the first discharge electrode facing the first substrate and a surface of the dielectric wall contacting the first substrate.

In one embodiment, the first discharge electrode includes a pair of first loop portions, each first loop portion having an open or closed loop, and a first bridge portion connected as a single body between the pair of the first loop portions, and the second discharge electrode includes a pair of second loop portions, each second loop portion having an open or closed loop, and a second bridge portion connected as a single body between the pair of the second loop portions. Here, each of the first loop portions may be larger in diameter than that of each of the second loop portions.

In one embodiment, the first discharge electrode includes a plurality of first discharge electrodes connected to each other so as to surround perimeters of a set of the discharge cells which are arranged adjacent to each other in the first direction, and the second discharge electrode includes a plurality of second discharge electrodes extending in the second direction crossing the set of the discharge cells arranged adjacent to each other.

In one embodiment, each of the first discharge electrodes includes a loop portion having an open or closed loop, and each of the second discharge electrodes has a stripe shape.

In one embodiment, each of the first discharge electrodes includes a loop portion having an open or closed loop, and each of the second discharge electrodes includes a stripe portion and a surface enlargement portion enlarged from a part of the stripe portion and positioned to correspond to a corresponding one of the discharge cells.

In one embodiment, each of the first discharge electrodes includes a loop portion having an open or closed loop, and each of the second discharge electrodes includes a stripe portion and a ring-shaped portion connected to the stripe portion as a single body and positioned to correspond to a corresponding one of the discharge cells.

In one embodiment, the dielectric wall includes at least one dielectric sheet having a plurality of opening holes in the at least one dielectric sheet at positions corresponding to the discharge cells.

In one embodiment, the plasma display panel further includes a protection layer on a surface of the dielectric wall.

In one embodiment, the plasma display panel further includes a protection layer between the plurality of discharge cells and the dielectric wall.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
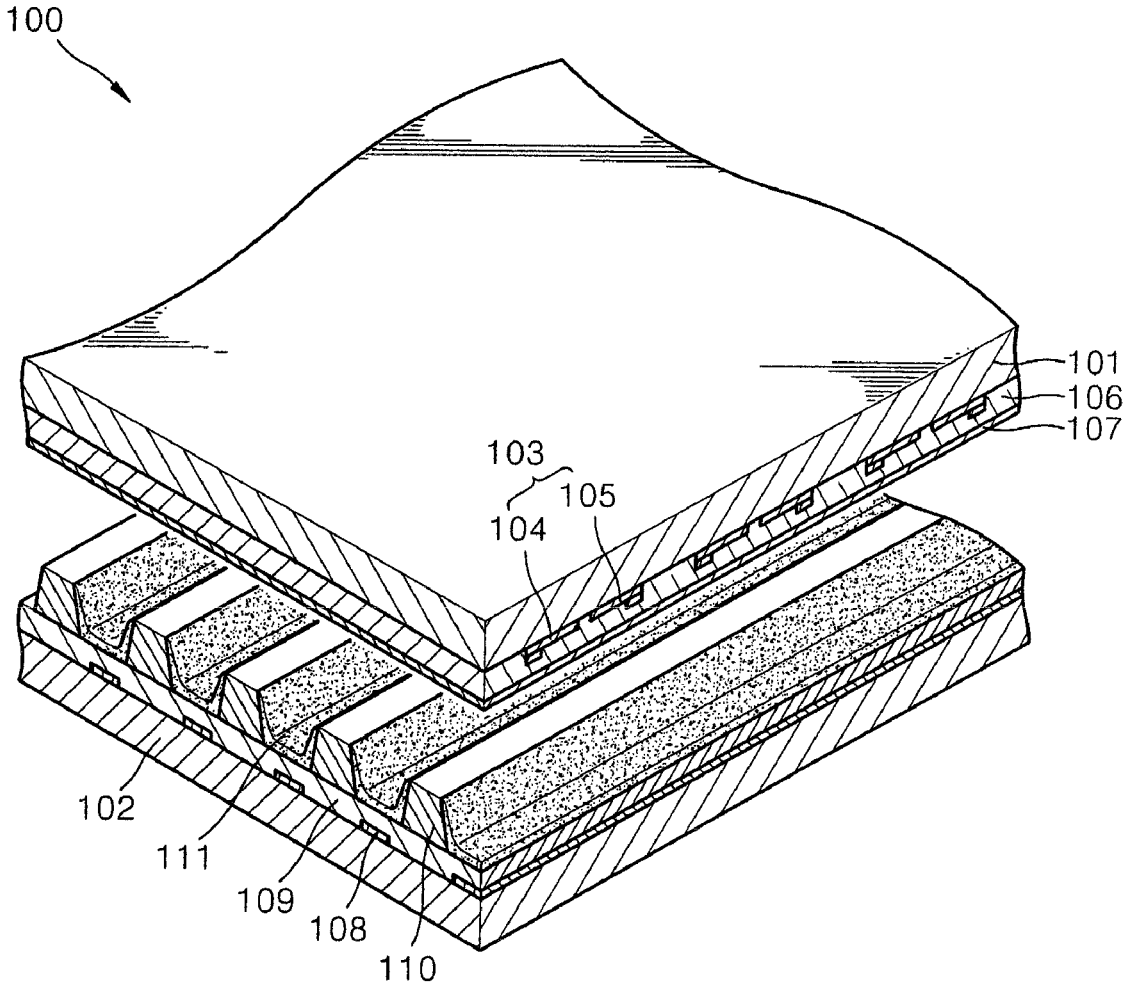
FIG. 1 (PRIOR ART)
FIG. 1 is a separate perspective partially cut schematic of a conventional plasma display panel.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on the another element or be indirectly on the another element with one or more intervening elements interposed therebetween. Like reference numerals designate like elements throughout the specification.

Figure 2:
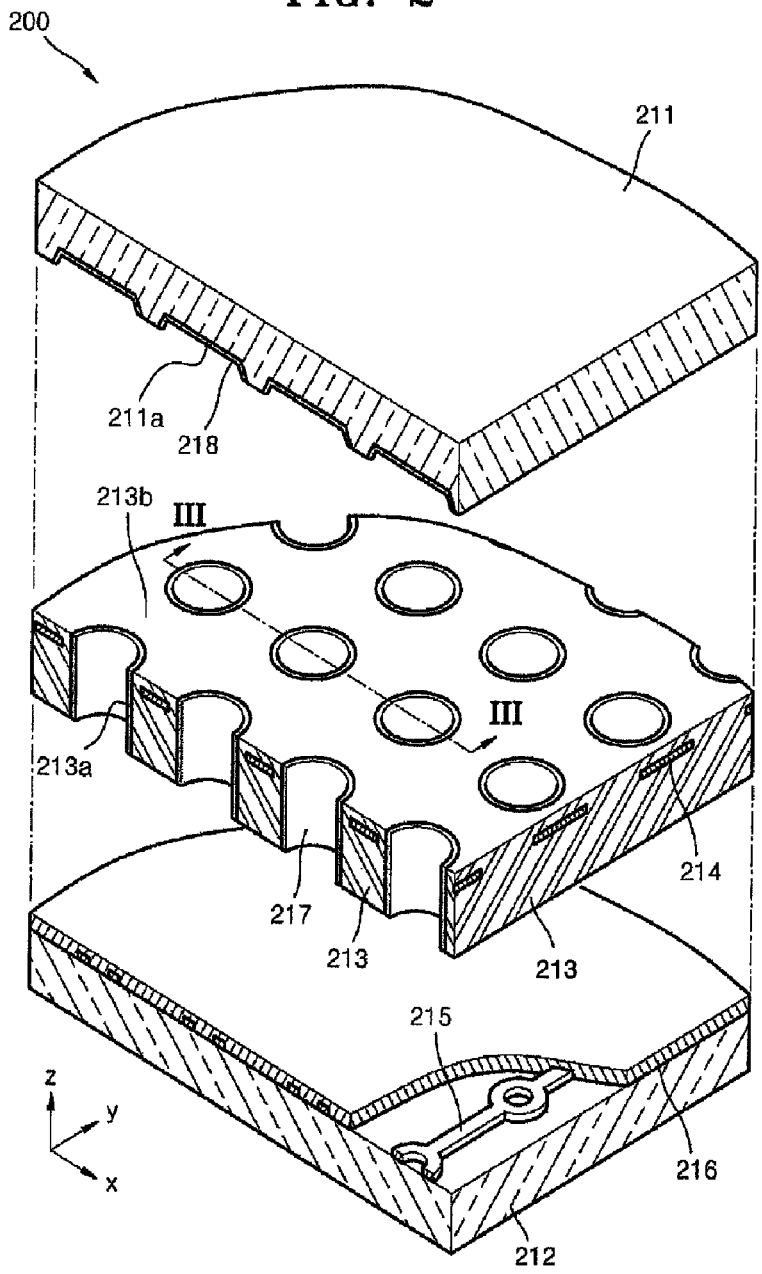
FIG. 2 is a separate perspective schematic of a plasma display panel according to an embodiment of the present invention.
Figure 3:
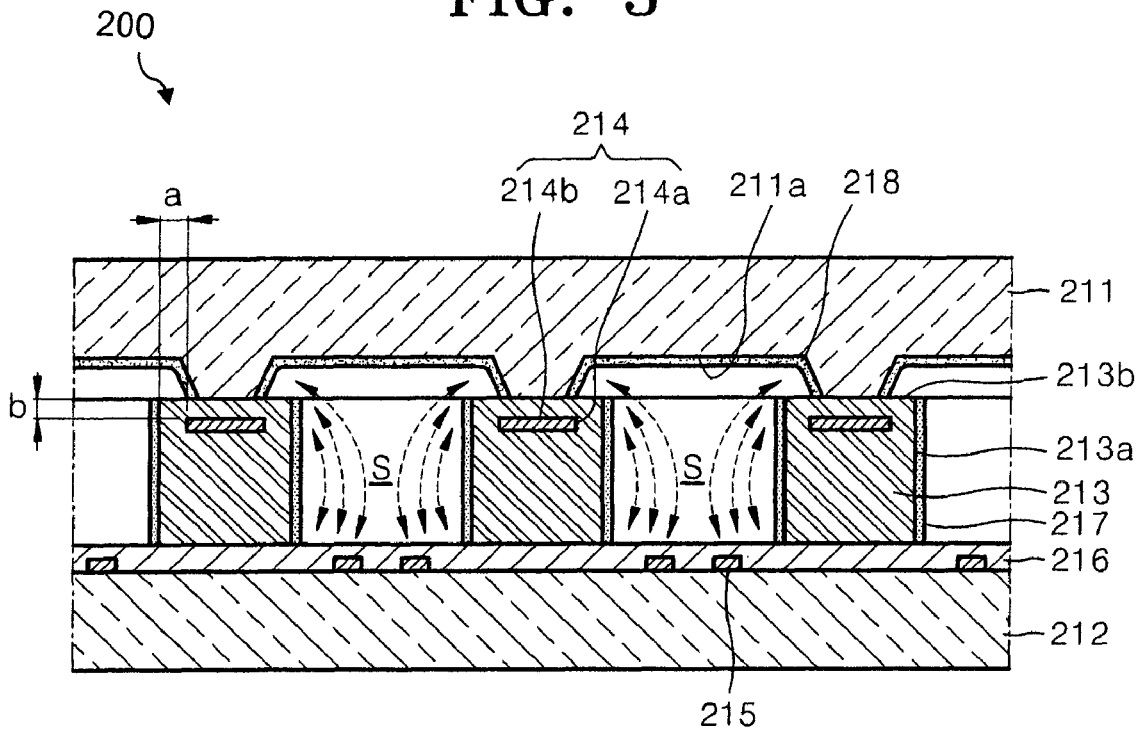
FIG. 3 is a cross-sectional schematic of the combination of the layers of the plasma display panel of FIG. 2 cut along a line III-III.
Figure 4:
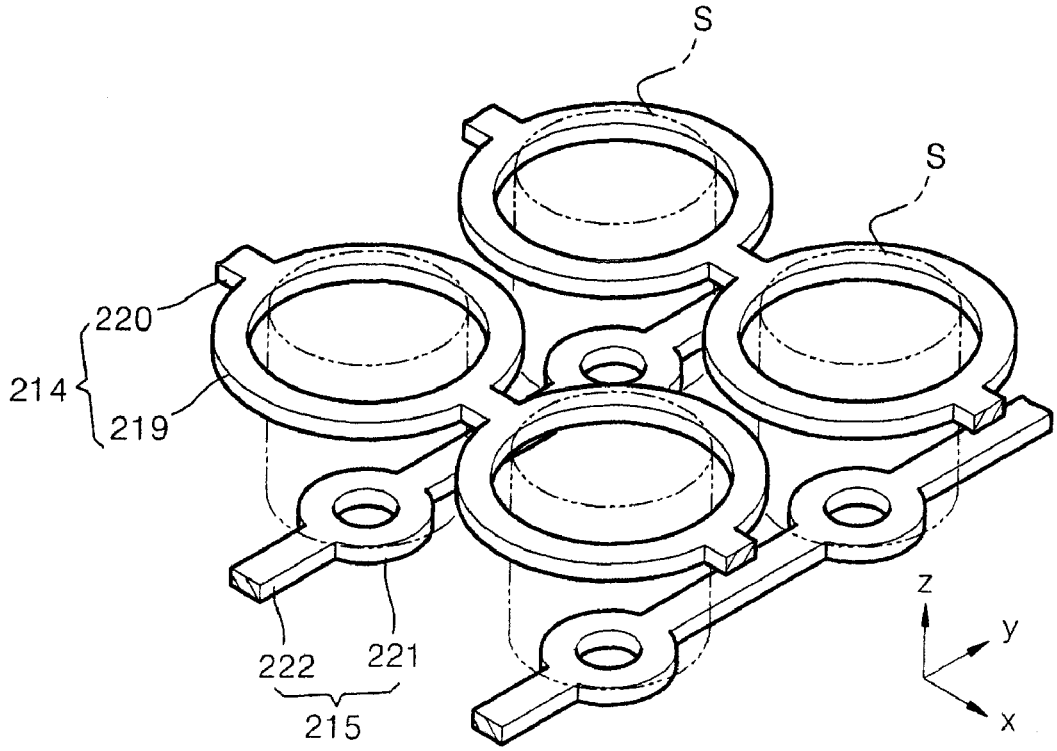
FIG. 4 is a separate perspective schematic illustrating discharge electrodes shown in FIG. 2.

FIG. 2 illustrates a plasma display panel 200 according to an embodiment of the present invention. FIG. 3 is a cross-sectional schematic of the combination of the layers of the plasma display panel 200 of FIG. 2 cut along a line III-III. FIG. 4 is a separate perspective schematic illustrating discharge electrodes illustrated in FIG. 2.

Referring to FIGS. 2 through 4, a first substrate 211 and a second substrate 212 are formed in the plasma display panel 200. The first substrate 211 and the second substrate 212 may be transparent, opaque, colored glass, plastic, etc., depending on whether the plasma display panel 200 is a transmitting type or a reflection type.

A dielectric wall 213 is disposed between the first substrate 211 and the second substrate 212 to partition discharge cells S and to prevent (or reduce) electric and optical cross-talk between the adjacent discharge cells S.

A first discharge electrode 214 is covered by (or buried in) the dielectric wall 213, and a second discharge electrode 215 is buried in a dielectric layer 216 on the second substrate 212. In one embodiment, the dielectric wall 213 and the dielectric layer 216 are formed of a high-k dielectric material that can prevent (or protect from) direct electric conduction between the first discharge electrode 214 and the second discharge electrode 215, can prevent (or reduce) damage of the first and second discharge electrodes 214 and 215 by anions and electrons and/or can accumulate wall charges by inducing charges.

The dielectric wall 213 is formed such that the discharge cells S have a circular horizontal cross-section, but the form of the discharge cells S is not limited thereto. In other words, the dielectric wall 213 can also be formed such that the discharge cells S have other various suitable forms such as a rectangular, circular, or non-circular cross-section, and can also define delta-type, waffle-type, or meander type discharge cells S.

A protection layer 217 may be formed on sidewalls of the dielectric wall 213. The protection layer 217 prevents (or protects) the first discharge electrode 214 from being damaged by sputtering of plasma particles and reduces discharge voltage by emitting secondary electrons at the same time (or substantially the same time). Magnesium oxide (MgO) can be used as the protection layer 217.

Discharge gas is injected and sealed in the discharge space of the discharge cells that is formed as the first substrate 211, the second substrate 212, and the dielectric wall 213 disposed between the first substrate 211 and the second substrate 212. According to an embodiment of the present invention as shown in FIGS. 2 through 4, a discharge surface area can be increased and a discharge area can be extended, and thus the amount of plasma increases and a low voltage driving is enabled. Accordingly, even when high density Xe gas is used as discharge gas, because low voltage driving is possible, the light emitting efficiency can be increased significantly.

Since a phosphor layer 218 is formed on the first substrate 211, the horizontal cross-section of a space in which the phosphor layer 218 is formed is larger than the horizontal cross-section of the discharge cells S.

In more detail, the dielectric wall 213 is formed of one or more dielectric sheets that are stacked. The dielectric sheets are stacked on one another in the z-direction, parallel to the plasma display panel 200, and a plurality of discharge cells S are later formed by forming opening holes corresponding to the position of the discharge cells S by punching the dielectric sheets and/or etching the dielectric sheets utilizing an etching process.

The dielectric wall 213 may be formed by stacking as a separate sheet on the first substrate 211 or the second substrate 212, or may be attached as a single body with the first substrate 211 or the second substrate 212 utilizing a dry or firing process; thus the manufacturing method of the dielectric wall 213 is not limited to any one method.

The first discharge electrode 214 is formed in the dielectric wall 213. The first discharge electrode 214 may be formed when forming the dielectric wall 213 by utilizing one or more dielectric sheets, and by patterning the one or more dielectric sheets. Here, at least one dielectric sheet is formed so as to entirely cover (or enclose) the first discharge electrode 214.

The protection layer 217 is further formed on the surface of the dielectric wall 213. The protection layer 217 can be formed only on the surface of the dielectric wall 213 contacting the discharge cells S or can be coated on the whole (or entire) surface of the dielectric wall 213; thus the manufacturing method of the protection layer 217 is not limited to any one method.

The first discharge electrodes 214 are extended in an x-direction of the plasma display panel 200 and, as such, electrically connect adjacent discharge cells in this direction, and are spaced apart at set (or predetermined) intervals in a y-direction of the plasma display panel 200.

The first discharge electrode 214 includes a first loop portion 219 in the form of an open loop or a closed loop surrounding the circumference (or perimeter) of each of discharge cells S and a first bridge portion 220 electrically connecting a pair of the adjacent first loop portions 219.

As described above, the first discharge electrode 214 is formed of the pairs of the first loop portions 219 and the bridge portions 220 that are repeatedly disposed in the X-direction of the plasma display panel 200. Alternatively, the first discharge electrode 214 may be formed of only the first loop portions 219 disposed repeatedly without the bridge portions 220.

Although the first loop portions 219 are in the form of a ring-shaped closed loop in the current embodiment of the present invention, the form of the first loop portions 219 is not limited thereto and may also be in other suitable forms such as a square or hexagon, either in an opened or closed loop. In one embodiment, the first loop portions 219 have substantially the same form (or shape) as the horizontal cross-section of the discharge cells S.

Also, the second discharge electrodes 215 are covered by (or buried in) the dielectric layer 216. The second discharge electrodes 215 are extended to cross the first discharge electrodes 214 (y-direction of the plasma display panel 200), and across the discharge cells S that are adjacently arranged, and are spaced a set (or predetermined) distance apart from each other along the x-direction of the plasma display panel 200.

The second discharge electrode 215 includes a second loop portion 221 with (or in the form of) an open loop or a closed loop in each of the discharge cells S and a second bridge portion 222 electrically connecting a pair of adjacent second loop portions 221.

Thus, the second discharge electrode 215 is formed of the pairs of the second loop portions 221 and the bridge portions 222 repeatedly formed between the pair of the second loop portions 221 along the Y-direction of the plasma display panel 200.

Although the second discharge electrode 215 is in the form of a ring-shaped closed loop in the current embodiment of the present invention, the form of the second discharge electrode 215 is not limited thereto and may also be in other suitable forms such as a square or hexagon, either in an opened or closed loop, or a rectangle, a circle, or an oval. The form of the second discharge electrode 215 is not limited as long as the second discharge electrode 215 can generate and diffuse discharge.

The first discharge electrode 214 functions both as a scan electrode during addressing and as a Y electrode during sustaining discharge, and the second discharge electrode 215 functions both as an address electrode during addressing and as an X electrode during sustaining discharge.

As the first discharge electrode 214 is not disposed on the inner surface of the first substrate 211 that directly reduces transmission ratio of visible light, the first discharge electrode 214 can be formed of highly conductive metal such as aluminum, copper, etc. Also, the second discharge electrode 215 can be formed of a highly conductive metal such as silver paste.

Also, while the first discharge electrode 214 is covered by (or buried in) the dielectric wall 213 along the circumference of the discharge cells S, the second discharge electrode 215 is disposed inside the discharge cells S. Accordingly, the diameter (or width) of the first loop portions 219 is larger than that of the second loop portions 221.

In one embodiment, a distance (a) between an edge of the first discharge electrode 214 and a surface 213*a* of the dielectric wall 213 contacting the discharge cells S is greater than a distance (b) between a surface 214*b* of the first discharge electrode 214 facing the first substrate 211 and a surface 213*b* of the dielectric wall 213 so that the diffusion path of discharge can be extended.

In addition, a plurality of grooves 21 la are formed corresponding to the discharge cells S on the inner surface of the first substrate 211 (or the surface of first substrate 211 facing the second substrate 212) using an etching process or a sand blasting process. A raw material for forming a phosphor layer is coated in the grooves 211 a and the phosphor layer 218 is formed by drying and firing the base material in the grooves 211*a*.

The phosphor layer 218 contains components for emitting visible light by receiving ultraviolet rays; a phosphor layer formed in a red light emitting cell includes a phosphor such as $Y(V,P)O_4$:Eu; a phosphor layer formed in a green light emitting cell includes a phosphor such as $Zn_2SiO_4$:Mn, $YBO_3$:Tb, etc.; and a phosphor layer formed in a blue light emitting discharge cell includes a phosphor such as BAM:Eu.

The horizontal cross-section of the grooves 211*a* is formed to be larger than the horizontal cross-section of the discharge cells S. As the horizontal cross-section of the grooves 211*a* is formed to be larger than the horizontal cross-section of the discharge cells S, a portion of the surface 213*b* of the dielectric wall 213 contacting the first substrate 211 is exposed to the discharge cells S.

Accordingly, a portion of the surface 213*b* of the dielectric wall 213 does not contact the inner surface of the first substrate 211, and the grooves 211*a* are extended, thereby extending the discharge space. Accordingly, the volume of plasma generated during discharge is increased.

The operation of the plasma display panel 200 having the above described structure will be described hereinafter in more detail.

First, addressing discharge is generated between the first discharge electrode 214 and the second discharge electrode 215. As a result of the addressing discharge, a discharge cell S in which sustaining discharge will be generated is selected. Then, when a sustaining discharge voltage is applied between the first discharge electrode 214 and the second discharge electrode 215 of the selected discharge cell S, a sustaining discharge is generated between the first discharge electrode 214 and the second discharge electrode 215.

The energy level of the excited discharge gas is lowered by the generated sustaining discharge and thus vacuum ultraviolet rays are emitted. The emitted vacuum ultraviolet rays excite the phosphor layer 218, and as the energy level of the excited phosphor layer 218 is lowered, visible light is emitted, and the emitted visible light realizes an image.

Here, discharge between the first discharge electrode 214 and the second discharge electrode 215 is initiated on the surface 213*a* of the dielectric wall 213 contacting (or adjacent to) the discharge cells S and the surface of the dielectric layer 216 and diffused gradually to the surface 213*b* of the dielectric wall 213 corresponding to the first substrate 211.

As the diffusion path of discharge is extended as described above, the volume of plasma generated during discharge is increased and the amount of vacuum ultraviolet rays generated during discharge is also increased. Accordingly, the amount of vacuum ultraviolet rays transmitted to the phosphor layer 218 formed in the grooves 211*a* of the first substrate 211 is increased, thereby increasing the discharge efficiency.

In particular, the distance (a) between an edge 214*a* of the first discharge electrode 214 and the surface 213*a* of the dielectric wall 213 contacting (or adjacent to) the discharge cell S is formed to be larger than the distance (b) between the surface 214*b* of the first discharge electrode 214 corresponding to the first substrate 211 and the surface 213*b* of the dielectric wall 213 contacting the first substrate 211, and thus the diffusion path is extended and the grooves 211*a* are extended to a portion of the surface 213*b* of the dielectric wall 213 corresponding to the first substrate 211. Thus plasma can efficiently arrive at the surface of the phosphor layer 218, thereby increasing the amount of visible light.

Figure 5:
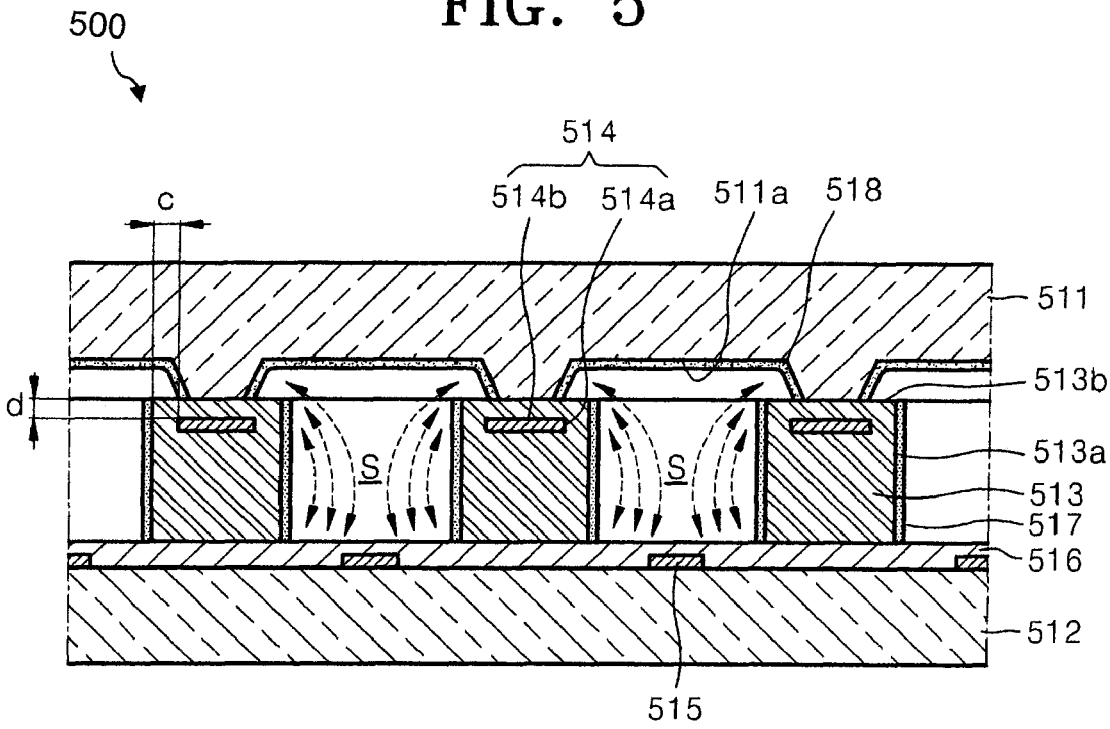
FIG. 5 is a cross-sectional schematic of the combination of layers of a plasma display panel according to another embodiment of the present invention.
Figure 6:
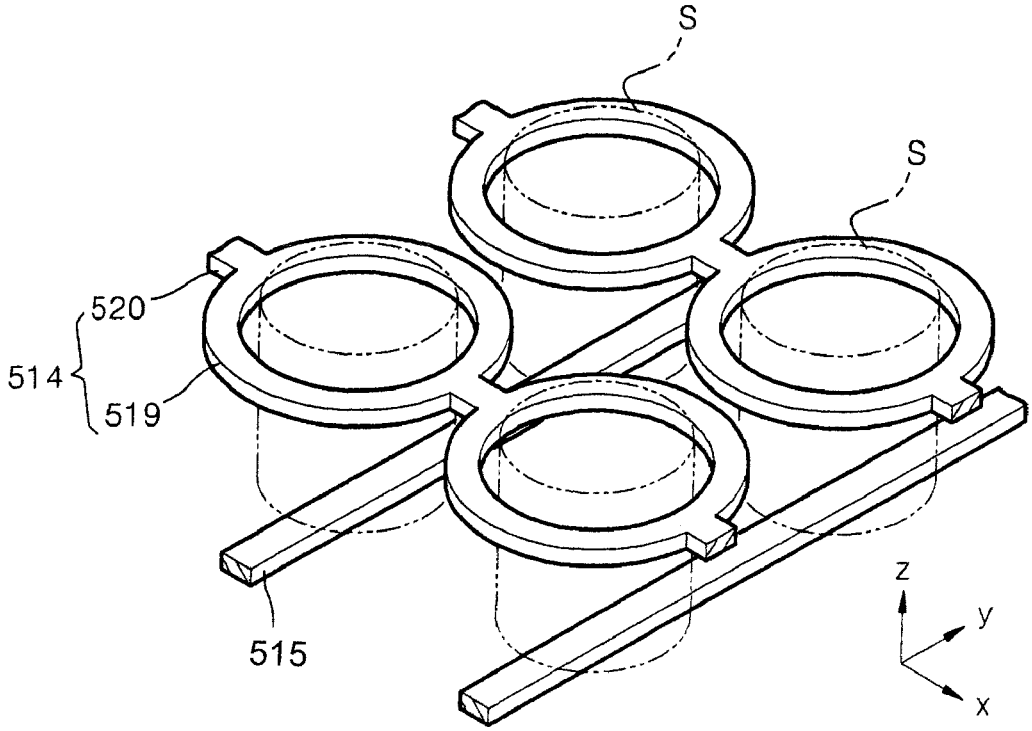
FIG. 6 is a separate perspective schematic illustrating discharge electrodes shown in FIG. 5.
Figure 7:
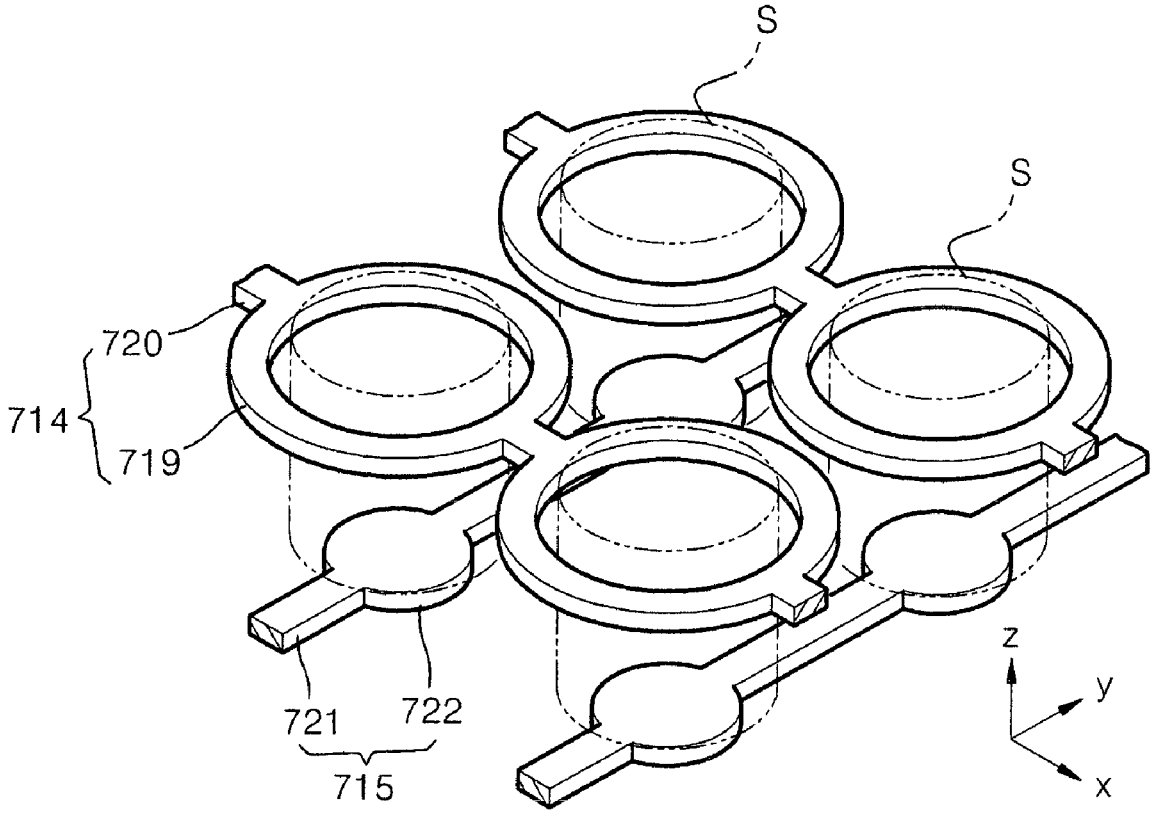
FIG. 7 is a separate perspective schematic illustrating another example of the discharge electrodes illustrated in FIG. 5.

FIG. 5 is a cross-sectional schematic of the combination of layers of a plasma display panel 500 according to another embodiment of the present invention. FIG. 6 is a separate perspective schematic illustrating the discharge electrodes of FIG. 5. FIG. 7 is a separate perspective schematic illustrating another example of the discharge electrodes of FIG. 5.

Referring to FIGS. 5 and 6, a first substrate 511 and a second substrate 512 are formed in the plasma display panel 500. A dielectric wall 513 formed of one or more stacked dielectric sheets is formed between the first substrate 511 and the second substrate 512.

A first discharge electrode 514 is covered by (or buried in) the dielectric wall 513, and a second discharge electrode 515 is covered by (or buried in) a dielectric layer 516 on the second substrate 512. A protection layer 517 may be further formed on sidewalls of the dielectric wall 513.

The first discharge electrodes 514 are extended in a first direction (e.g., x-direction) of the plasma display panel 500 and as such electrically connect discharge cells S adjacently arranged in this direction, and are spaced a set (or predetermined) distance apart from each other in a second direction (e.g., y-direction) of the plasma display panel 500.

Each first discharge electrode 514 includes a loop portion 519 in a ring form such as an open loop or a closed loop surrounding the circumference (or perimeter) of each of discharge cells S and a bridge portion 520 electrically connecting a pair of the adjacent loop portions 519.

The second discharge electrodes 515 are extended to cross the first discharge electrodes 514, that is, in the second direction (e.g., the y-direction) of the plasma display panel 500, and across the discharge cells S that are adjacently arranged, and are spaced apart a set (or predetermined) distance from each other in the first direction (e.g., x-direction) of the plasma display panel 500.

The second discharge electrodes 515 are arranged in the form of stripes (or are stripe electrodes) which cross the adjacently arranged discharge cells. In another embodiment as shown in FIG. 7, each second discharge electrode 715 includes a stripe portion 721, and a discharge enlargement portion 722 whose surface is enlarged from the sidewalls of the stripe portions 721 illustrated in FIG. 7, but the present invention is not limited to this one exemplary form. Also, in FIG. 7, each first discharge electrode 714 includes a loop portion 719 in a ring form such as an open loop or a closed loop surrounding the circumference of each of discharge cells S and a bridge portion 720 electrically connecting a pair of the adjacent loop portions 719.

Referring to FIG. 5, a distance (c) between an edge 514*a* of the first discharge electrode 514 and a surface 513*a* of the dielectric wall 513 contacting the discharge cell S is formed to be larger than a distance (d) between a surface 514*b* of the first discharge electrode 514 facing the first substrate 511 and a surface 513*b* of the dielectric wall 513 contacting the first substrate 511.

Furthermore, grooves 511 a are formed on the inner surface of the first substrate 511 corresponding to the discharge cells S, and a phosphor layer 518 is formed in the grooves 511*a*.

Here, the horizontal cross-section of the grooves 511*a* is formed to be larger than the horizontal cross-section of the discharge cells S. Accordingly, the grooves 511*a* are extended to the surface 513*b* of the dielectric wall 513 contacting the first substrate 511.

Accordingly, as the size of the grooves 511*a* in which the phosphor layer 518 is formed becomes larger than the size of the discharge cells S, the discharge space is extended and the volume of plasma is increased, thus obtaining high discharge efficiency.

The plasma display panel according to an embodiment of the present invention includes a plurality of substrates and a dielectric wall defining discharge cells, wherein discharge electrodes are respectively covered by (or buried in) the substrates and distances between the dielectric wall and the first discharge electrode are suitably varied, and the size of the grooves in which a phosphor layer is formed is larger than the size of the discharge cells. Thus the discharge path is extended, the diffusion amount of discharge is increased, and plasma can efficiently arrive at the phosphor layer, thereby increasing discharge efficiency.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display panel comprising:

a first substrate and a second substrate utilized for displaying images;

a dielectric wall between the first and second substrates and defining a plurality of discharge cells;

a first discharge electrode within the dielectric wall and extending along a first direction;

a second discharge electrode on the second substrate, inside the discharge cells, and extending along a second direction crossing the first direction of the first discharge electrode; and a phosphor layer on the first substrate, wherein the first substrate has a plurality of grooves in each of which the phosphor layer is coated to correspond to the discharge cells, wherein each of the grooves coated with the phosphor layer provides an open space, wherein the open space provided by each of the grooves with the phosphor layer coated thereon has a horizontal cross-section larger in area than that of each of the discharge cells, and wherein the first substrate is a single substrate.

2. The plasma display panel of claim 1, wherein a portion of a surface of the dielectric wall for contacting the first substrate is exposed to the discharge cells due to the larger cross-sections of the grooves.

3. The plasma display panel of claim 1, wherein a distance between an edge of the first discharge electrode and a surface of the dielectric wall contacting the discharge cells is greater than a distance between a surface of the first discharge electrode facing the first substrate and a surface of the dielectric wall contacting the first substrate.

4. The plasma display panel of claim 1, wherein the first discharge electrode comprises a plurality of first discharge electrodes connected to each other so as to surround perimeters of a set of discharge cells which are arranged adjacent to each other in the first direction, and wherein the second discharge electrode comprises a plurality of second discharge electrodes extending in the second direction crossing the set of the discharge cells arranged adjacent to each other.

5. The plasma display panel of claim 4, wherein each of the first discharge electrodes comprises a loop portion having an open or closed loop, and wherein each of the second discharge electrodes has a stripe shape.

6. The plasma display panel of claim 4, wherein each of the first discharge electrodes comprises a loop portion having an open or closed loop, and wherein each of the second discharge electrodes comprises a stripe portion and a surface enlargement portion enlarged from a part of the stripe portion and positioned to correspond to a corresponding one of the discharge cells.

7. The plasma display panel of claim 4, wherein each of the first discharge electrodes comprises a loop portion having an open or closed loop, and wherein each of the second discharge electrodes comprises a stripe portion and a ring-shaped portion connected to the stripe portion as a single body and positioned to correspond to a corresponding one of the discharge cells.

8. The plasma display panel of claim 1, wherein the first discharge electrode comprises a pair of first loop portions, each first loop portion having an open or closed loop, and a first bridge portion connected as a single body between the pair of the first loop portions, and wherein the second discharge electrode comprises a pair of second loop portions, each second loop portion having an open or closed loop, and a second bridge portion connected as a single body between the pair of the second loop portions.

9. The plasma display panel of claim 8, wherein each of the first loop portions is larger in diameter than that of each of the second loop portions.

10. The plasma display panel of claim 1, wherein the dielectric wall comprises at least one dielectric sheet having a plurality of opening holes in the at least one dielectric sheet at positions corresponding to the discharge cells.

11. The plasma display panel of claim 1, further comprising a protection layer on a surface of the dielectric wall.

12. The plasma display panel of claim 1, further comprising a protection layer between the plurality of discharge cells and the dielectric wall.

13. A plasma display panel comprising:

a first substrate;

a second substrate facing the first substrate;

a dielectric wall between the first and second substrates and defining a plurality of discharge cells;

a first discharge electrode within the dielectric wall and extending along a first direction;

a second discharge electrode on the second substrate, inside the discharge cells, and extending along a second direction crossing the first direction of the first discharge electrode; and a phosphor layer on the first substrate, wherein the first discharge electrode is configured within the dielectric wall and with the phosphor layer to increase a discharge path, wherein the first substrate has a plurality of grooves in each of which the phosphor layer is coated to correspond to the discharge cells, wherein each of the grooves coated with the phosphor layer provides an open space, wherein the open space provided by each of the grooves with the phosphor layer coated thereon has a horizontal cross-section larger in area than that of each of the discharge cells, and wherein the first substrate is a single substrate.

14. The plasma display panel of claim 13, wherein a portion of a surface of the dielectric wall for contacting the first substrate is exposed to the discharge cells due to the larger cross-sections of the grooves.

15. The plasma display panel of claim 13, wherein a distance between an edge of the first discharge electrode and a surface of the dielectric wall contacting the discharge cells is greater than a distance between a surface of the first discharge electrode facing the first substrate and a surface of the dielectric wall contacting the first substrate.

16. The plasma display panel of claim 13, wherein the first discharge electrode comprises a pair of first loop portions, and a first bridge portion connected as a single body between the pair of the first loop portions, and wherein the second discharge electrode comprises a pair of second loop portions, and a second bridge portion connected as a single body between the pair of the second loop portions.

17. The plasma display panel of claim 16, wherein each of the first loop portions is larger in diameter than that of each of the second loop portions.

18. The plasma display panel of claim 13, wherein the first discharge electrode comprises a pair of first loop portions, and a first bridge portion connected as a single body between the pair of the first loop portions, and wherein the second discharge electrode is a stripe electrode or comprises a stripe portion and a surface enlargement portion enlarged from a part of the stripe portion and positioned to correspond to a corresponding one of the discharge cells.

* * * * *